United States Patent [19]

Kuhr

[11] 4,377,059

[45] Mar. 22, 1983

[54] CONCEALED CEILING SYSTEM WITH ACCESSIBLE CEILING PANELS

[75] Inventor: Albert F. Kuhr, Elk Grove Village, Ill.

[73] Assignee: United States Gypsum Company, Chicago, Ill.

[21] Appl. No.: 176,733

[22] Filed: Aug. 11, 1980

Related U.S. Application Data

[63] Continuation of Ser. No. 943,882, Sep. 18, 1978, abandoned.

[51] Int. Cl.[3] ..... E04B 1/00

[52] U.S. Cl. ..... 52/98; 52/221; 52/311; 52/484; 83/53; 98/40 D

[58] Field of Search ..... 144/314 B, 319, 323; 181/284; 52/144, 98, 311, 484, 221, 313, 314, 488, 127; 428/43, 53; 83/53; 98/40 D, 40 DL

[56] References Cited

U.S. PATENT DOCUMENTS

| | | | |
|---|---|---|---|
| 2,410,413 | 11/1946 | Hurley | 52/144 |
| 2,413,568 | 12/1946 | Hurley | 52/144 |
| 2,830,330 | 4/1958 | Heath | 52/144 |
| 3,121,259 | 2/1964 | Versen | 52/144 |
| 3,977,933 | 8/1976 | Sadashige | 428/53 |
| 4,048,885 | 9/1977 | Miyakita | 83/53 |

FOREIGN PATENT DOCUMENTS

| | | | |
|---|---|---|---|
| 1108046 | 1/1956 | France | 428/53 |

*Primary Examiner*—John E. Murtagh

*Attorney, Agent, or Firm*—Jerome J. Adams; Robert H. Robinson; S. Kurlandsky

[57] ABSTRACT

A suspended ceiling system comprising a plurality of inverted-T runners. Kerfed edge ceiling tile supported by runners and concealing the bottom of the runners. At least one ceiling tile having a central portion removable therefrom by being separable along a substantially vertical fine cut made by high pressure fluid jet cutting.

11 Claims, 5 Drawing Figures

CONCEALED CEILING SYSTEM WITH ACCESSIBLE CEILING PANELS

This is a continuation of application Ser. No. 943,882, filed Sept. 18, 1978, now abandoned.

THE BACKGROUND OF THE INVENTION (1) Field of the Invention

The invention relates to concealed suspended ceiling construction facilitating accessibility and capable of variable lighting, air distribution, and decorative appearance without panel or runner disassembly.

(2) Description of the Prior Art

Accessible suspended ceiling systems are in wide use in the building construction industry. It is necessary in many of these constructions to have direct entry to the ceiling plenum for access to electrical, plumbing, air distribution, and other services without damage to the ceiling panels or components.

Typically, accessibility is attained by the removal of ceiling panels demountably coacting with ceiling runners. Numerous suspended ceiling constructions provide aesthetically pleasing decorative lower faces of the panels. The ability to alter the overall decorative pattern is limited in that the entire panel must be removed and replaced to change the appearance. Also, the location of lighting and air distribution fixtures is restrained to specified locations subject to relocation only upon complete removal of particular panel units.

Some systems attempt to overcome the restriction on changeability by utilizing separately mounted recesses lighting fixtures whereby the ceiling panels have no supportive dependence on the lighting or air distribution fixtures. Such constructions overcome the problems by providing additional complex structural components involving lengthier installation and increased manufacturing costs.

(3) Objects of the Invention

It is a primary object of the invention to provide a concealed suspended ceiling which allows direct entry to the ceiling plenum for access to electrical, plumbing, air distribution, and other utilities and services without damage to the ceiling tile or components.

It is an important object of this invention to provide a suspended ceiling system and ceiling tile usable therein having the capacity to change the ceiling pattern appearance to coordinate room and ceiling decor by modifiable access panel fixtures.

It is accordingly an object of this invention to provide a suspended ceiling system that allows the deletion or relocation of lighting and air distribution units prior to, or following, installation.

It is a concomitant objective of this invention to attain accessibility, relocatability, and variable decorative appearance while permitting ceiling tile to remain engaged to ceiling runners during such transformations.

SUMMARY OF THE INVENTION

The objects of this invention are attained with a suspended ceiling system comprising a plurality of inverted-T runners and kerfed edge ceiling tiles supported by said inverted-T runners. The ceiling tile concealed the bottom of the runners. At least one ceiling tile has a central portion removable therefrom by being separable along a substantially vertical fine cut made by high pressure fluid jet cutting.

In attaining the objects of this invention the suspended ceiling system provides a removable portion separable from the remainder of the ceiling tile along a fine cut of from about 0.002 inches to about 0.020 inches. The cut is virtually unnoticeable. This allows the removed portion to be vertically displaced to provide a decorative offset shadowlike appearance without the plenum being exposed to view along the path of the cut.

The goals of the invention are fully attained by providing a decorative fixture interchangeable with the removable ceiling tile portion. In satisfying the objects of the invention decorative fixtures may be provided in recessed, flush or dropped alignment. Additionally satisfying the objects of this invention, a decorative fixture may be provided with foraminous construction for air distribution systems, or may compose a lens shield made from translucent material for utility with lighting fixtures positioned thereabove.

BRIEF DESCRIPTION OF THE DRAWINGS

The foregoing and more specific objects of the invention are attained by the construction and arrangement illustrated in the accompanying drawings wherein.

DESCRIPTION OF THE PREFERRED EMBODIMENTS

Figure 1:
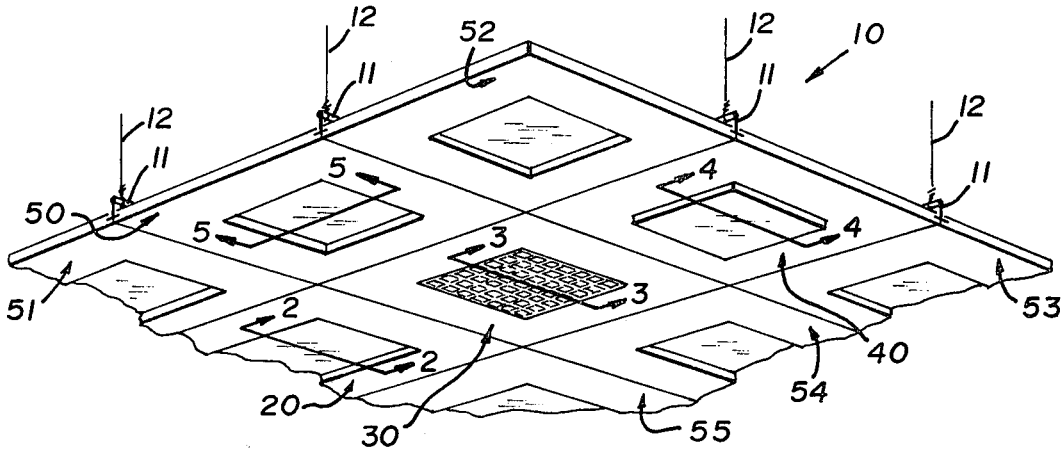
FIG. 1 is a general perspective view looking upward at a portion of the suspended ceiling system and accessible ceiling tile in accordance with this invention.

FIG. 1 illustrates suspended ceiling system 10 in accordance with the preferred embodiment of this invention. In this embodiment, inverted-T runners 11 are connected to an upper support structure (not shown) by hanger wires 12. Runners 11 engage panels denoted as ceiling tiles 20, 30, 40 and 50–55. The embodiment illustrated the versatility of this suspended ceiling system 10 in that ceiling system 10 provides adaptability for lighting at tile 20, air distribution at tile 30, decorative changeability at tiles 40, and 50–55.

In providing the ceiling tile in suspended ceiling system 10 it is noted that the accessibility and changeability is most desirably attained by providing substantially identical dimensions to the openings in the ceiling tile. Thereby, the preferred embodiment permits interchangeability of the system components to provide versatility as required.

Figure 2:
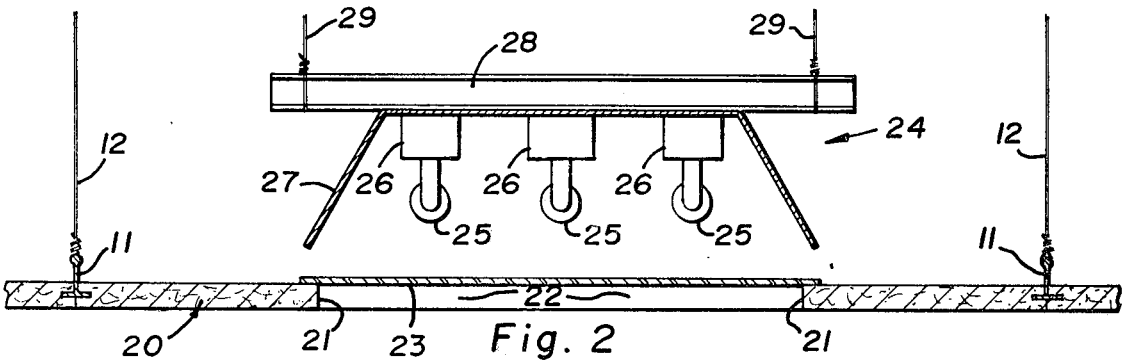
FIG. 2 is a cross-sectional view taken along the lines 2—2 of FIG. 1 showing the adaptation of the suspended ceiling for use with a lighting fixture.

FIG. 2 illustrates ceiling tile 20 of suspended ceiling system 10 in cross-sectional view. Ceiling tile 20 has a vertical cut 21 in a central portion of the tile providing an opening 22. Vertical cut 21 is a sharp smooth cut having no ragged or erratic portions due to the use of high pressure fluid jet cutters in attaining this cut. At ceiling tile 20 a lens shielding 23 is positioned over opening 22. This lens shielding 23 is preferably a translucent material used in conventional lighting systems. The lens shielding 23 is installable and removable by simply displacing it slightly and sliding it through opening 22 without disassembling ceiling tile 20, inverted-T runners 11, or hanger wires 12. Disposed and separately supported above ceiling tile 20 is a light assembly 24. Assembly 24 comprises a plurality of lights 25 preferably being tubular fluorescent. Lights 25 are mounted to light fixtures 26 which furnish connection to a source of electricity. Disposed around the lights 25 and light fixtures 26 is reflector 27 provided to reflect light through lens shielding 23. Light assembly 24 is supported by a support channel 28 which is suspended from an upper support structure by hanger wires 29 independently from inverted-T runners 11 and hanger wires 12.

Figure 3:
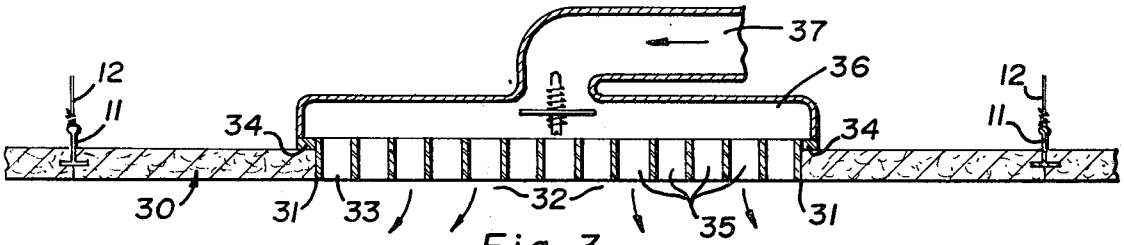
FIG. 3 is a cross-sectional view taken along lines 3—3 of FIG. 1 looking in the direction of the arrows and showing a foraminous fixture adaptable with the suspended ceiling system and usable with air distribution systems in accordance with the invention.

Turning now to FIG. 3, ceiling tile 30 is shown usable with a preferred air distribution system for ceiling system 10. Ceiling tile 30 has fine vertical cut 31 which allows removal of a central portion of the tile. The fineness of vertical cut 31 is accomplished by the use of high pressure fluid jet cutters. Opening 32 receives flush shielding 33 which is preferably foraminous. Flush shielding 33 includes shoulders 34 which rest atop ceiling tile 30. Bottom portions of flush shielding 33 are coplanar with bottom portions of ceiling tile 30 to provide a continuous planar ceiling surface across this tile. In providing a foraminous design, openings 35 extend through flush shielding 33. The openings 35 provide avenues of passage for air streams caused by air distribution bar 36 which is mounted atop ceiling tile 30. Conduit 37 feeds air distribution bar 36 with air flow emanating from a conventional centrally located source. Air distribution bar 36 is aduerbial comprised of a mounting rim 38 having substantially the same dimensions as shoulders 34 to facilitate air passage through shielding 33. However, air distribution bar 36 may extend fully across ceiling tile 30 and be supported by inverted-T runners 11. Complete accessibility is provided with this configuration in that flush shielding 33 may be slightly displaced and slid through opening 32. With this capacity the system may be changed from individual air distribution bar mechanisms to a pressurized plenum, or completely changed by eliminating air system mechanisms and having a decorative tile surface.

Figure 4:
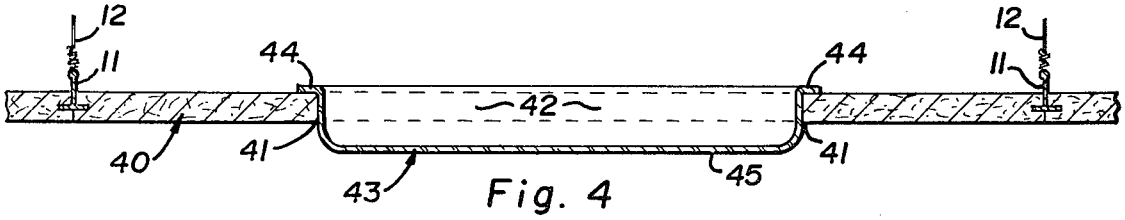
FIG. 4 is a cross-sectional view taken along line 4—4 of FIG. 1 looking in the direction of the arrows, showing a dropped dish fixture adaptable for use with the suspended ceiling system in accordance with this invention.

FIG. 4 provides ceiling tile 40 having a decorative surface when viewed from below. Ceiling tile 40 has vertical cut 41 which has a fine surface attained by the use of high pressure fluid jet cutters. Vertical cut 41 bounds opening 42. In this configuration a decorative appearance is preferably provided by a shielding 43 which is supported by ceiling tile 40 along lips 44. Shielding 43 has a bottom exposed surface 45 which depends below the bottom surface of ceiling tile 40 to provide an aesthetically pleasing "dropped dish" conformation. Shielding 43 is removable by slight displacement and withdrawal through opening 42. Thereby, full accessibility is provided plus interchangeability with the components used at ceiling tile 20, 30, and 50–55.

Figure 5:
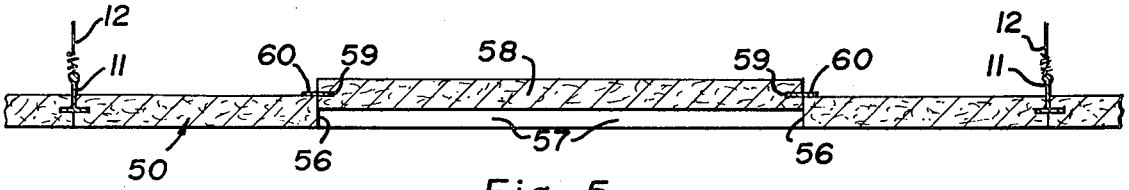
FIG. 5 is a cross-sectional view taken along line 5—5 of FIG. 1 looking in the direction of the arrows and showing a ceiling tile in accordance with this invention providing the offset interchangeable removable portion of accessible ceiling tile.

FIG. 5 depicts ceiling tile 50 having a vertical cut 56 made by high pressure fluid jet cutters creating an opening 57 wherein removable portion 58 is disposed. In this configuration the removable portion 58 remains with the ceiling tile 50 from which it was extricated. The removed portions may remain with the ceiling tile 20, 30 and 40 of FIGS. 2–4 if such is desired. In this configuration, removable portion 58 is provided with a kerf 59 having a spline member 60 inserted therein. Spline 60 permits removable portions 58 to contact upper surfaces of ceiling tile 50 and be thereby supported. In this preferred embodiment for the invention, removable portion 58 is vertically displaced slightly above the lower planar surfaces of ceiling tile 50 and provides an aesthetically pleasing "shadow line" effect.

Throughout all FIGS. 2–5 it is preferred that the inverted-T runners 11 engage the ceiling tile within kerfed marginal edges and thereby are concealed from view below.

The material preferably comprising ceiling tiles 20, 30, 40, 50–55 is mineral fiber. However, wood fiber is equally suitable. Additionally, other materials may be utilized such as gypsum, wood and conventional acoustical panels. Most conventional ceiling panels may be provided with a fine vertical cut by the use of high pressure fluid jet cutters. Such cutters utilize pressures ranging from 30,000 to 60,000 psi and provide a cut having a width of from about 0.002 inches to about 0.020 inches. In this manner, with particular references to FIG. 5, it can be seen that at the interface between the removable portion 58 and ceiling tile 50 a flush virtually unnoticeable separation, cut 56, is provided. In this manner, removable portion 58 may be removed from ceiling tile 50 to be utilized in ceiling tiles 20, 30, or 40 interchangeably. With a fluid jet cut the separation is virtually unnoticeable thereby eliminating the possibility that the unsightly utilities above the suspended ceiling system may be seen from below through slits or cracks.

Furthermore, with reference to FIG. 3, air distribution bar 36 may be relocated and a flush shielding 33 may be provided without openings 35 to thereby provide a continuous coplanar surface uninterrupted by openings.

The invention in the preferred embodiments herein disclosed provides a suspended ceiling system 10 that offers relatively low cost simplified installation and modification. Critical to the invention is the new access panel providing direct entry to the ceiling plenum without damage or interruption to the ceiling tile, runners, or components. It is also demonstrated in the Figures that suspended ceiling system 10 has the capacity to alter ceiling appearance to coordinate room and ceiling decor by rearranging inserted portions as illustrated by the interchangeability of lens shielding 23, flush shielding 33, shielding 43 and removable portion 58. Additionally, the invention provides a suspended ceiling system which allows the deletion, addition, or relocation of air and lighting systems before or after installation.

Ceiling tile 51, 52, 53 and 54 are provided in the preferred embodiment illustrated by suspended ceiling system 10 with substantially identical characteristics as shown for ceiling tile 50. It is preferred, that the predominant ceiling tile configuration in suspended ceiling system 10 utilize the one illustrated in FIG. 5. As utilities, lighting, and air distribution mechanisms are provided at various locations, panels having the configuration of ceiling tile 50–55 may be coordinately aligned in aesthetically pleasing patterns suited to a particular taste.

The invention envisions the utilization of concealed inverted-T runners 11 wherein the bottom portions are concealed within kerfed edges of the ceiling tile. Neither the remaining portions of the ceiling tile nor the runner and hanger wire assembly need to be damaged or removed to attain accessibility and versatility of the suspended ceiling system and access panel provided in this new and novel invention.

The embodiment disclosed herein is presently considered to be the preferred form of the invention the changes and modifications may be made therein and it is intended that the claims appended hereto shall cover such changes as found within the scope of this invention.

I claim:

1. A suspended ceiling system comprising:

a plurality of inverted-T runners concealed within said system;

kerfed edge ceiling tiles supported at said kerfed edges by said inverted-T runners, adjacent said tiles being in proximate contact along the lower edge surfaces thereof distal said inverted-T runners concealing said inverted-T runners from view below, wherein;

at least one said ceiling tile in said system comprises a central portion coplanar with the remainder of said tile and optionally vertically demountable and separable from the remainder of said tile along a cut defining said central portion through said tile perpendicular to the upper and lower surfaces thereof, said cut having a width no greater than 0.020 inches and further defining upon optional removal of said central portion a central opening within said ceiling tile wherein said central portion is recessed upwardly of the lower surface of said tile.

2. The suspended ceiling system of claim 1 wherein the said ceiling tile comprising an optionally removable central portion comprises the entirety of said ceiling tiles.

3. The ceiling system of claim 1 wherein the central portion of the tile comprising an optionally vertically demountable central portion is removed therefrom, provided with kerfing on the edges thereof for adaptively receiving spline means, said central portion being reinserted into the central opening of said tile from the upper surface aspect thereof.

4. The ceiling system of claim 1 wherein the central portions of each of the tiles comprising an optionally vertically demountable and separable central portion are of identical geometric configuration and dimension and are situate identically within said tile.

5. The ceiling system of claim 4 wherein the central portion of each of said tiles is of identical geometric shape and defines central openings equidistant the periphery of said tiles.

6. The suspended ceiling system of claim 1 wherein the optionally vertically demountable and separable central portion is vertically displaced upward and lower surface of said tile to remain in frictional engagement with the periphery of said central opening.

7. A ceiling system comprising ceiling tiles comprising a peripheral portion and a central portion wherein the peripheral edge of said peripheral portion is provided with a kerf parallel the upper and the lower faces of said tile, said kerf being of depth sufficient to suspendedly receive during installation of said tile the edge of an inverted-T runner and to completely conceal said inverted-T runner from view below upon suspended juxtaposition of said tile with a next adjacent tile in ceiling assembly array, the central portion of said tile being optionally demountable before or after installation along a cut through said tile perpendicular to the planar surfaces and edge kerfing thereof, said perpendicular cut being of width no greater than 0.020 inches wherein said optionally vertically demountable central portion is recessed upwardly of the peripheral portion of said tile.

8. The suspended ceiling system of claim 7 wherein the said ceiling tile comprising an optionally removable central portion comprises the entirety of said ceiling tiles.

9. The ceiling system of claim 7 wherein the central portion of the tile comprising an optionally vertically demountable central portion is removed therefrom, provided with kerfing on the edges thereof for adaptively receiving spline means, said central portion being reinserted into the peripheral portion of said tile from the upper surface aspect thereof.

10. The ceiling system of claim 7 wherein the central portions of each of the tiles comprising an optionally vertically demountable and separable central portion are of identical geometric configuration and dimension and are situate identically within said tile.

11. The ceiling system of claim 10 wherein the central portion of each of said tiles is of identical geometric shape define central openings equidistant the periphery of said tiles.

* * * * *